US009604444B2

(12) United States Patent
Mantani et al.

(10) Patent No.: US 9,604,444 B2
(45) Date of Patent: Mar. 28, 2017

(54) SCREEN PRINTING MACHINE OPERATING BASED ON PRINTING CONDITIONS

(71) Applicant: PANASONIC INTELLECTUAL PROPERTY MANAGEMENT CO., LTD., Osaka (JP)

(72) Inventors: Masayuki Mantani, Yamanashi (JP); Mitsuru Kouchi, Yamanashi (JP); Takashi Ono, Yamanashi (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 14/580,805

(22) Filed: Dec. 23, 2014

(65) Prior Publication Data

US 2015/0183210 A1 Jul. 2, 2015

(30) Foreign Application Priority Data

Dec. 27, 2013 (JP) ..... 2013-271260

(51) Int. Cl.

| | |
|---|---|
| ***B41F 15/44*** | (2006.01) |
| ***B41F 15/08*** | (2006.01) |
| *B41F 15/00* | (2006.01) |
| *B41M 1/26* | (2006.01) |
| *B41M 1/12* | (2006.01) |

(52) U.S. Cl.

CPC ..... *B41F 15/0881* (2013.01); *B41F 15/00* (2013.01); *B41F 15/08* (2013.01); *B41M 1/12* (2013.01); *B41M 1/26* (2013.01)

(58) Field of Classification Search

CPC ..... B41F 15/00; B41F 15/08; B41F 33/16; B41F 1/26

See application file for complete search history.

(56) References Cited

U.S. PATENT DOCUMENTS 7,171,897 B2 * 2/2007 Barajas ..... H05K 3/1233 101/123

2004/0244613 A1 12/2004 Barajas et al.

FOREIGN PATENT DOCUMENTS

| | | | |
|---|---|---|---|
| JP | 07-032717 A | | 2/1995 |
| JP | 2008-173839 | | 7/2008 |
| KR | 2006067771 A | * | 6/2006 |

* cited by examiner

*Primary Examiner* — Leslie J Evanisko
*Assistant Examiner* — Quang X Nguyen
(74) *Attorney, Agent, or Firm* — Pearne & Gordon LLP

(57) ABSTRACT

A screen printing machine includes a printing execution unit which fills a pattern hole of a mask with solder by sliding a squeegee on the mask contacting a board and thereafter separates the board from the mask. The screen printing machine further includes: a library which stores printing conditions, each of which includes operation parameters of the printing execution unit and corresponds to a combination of options of selection items which include aboard type, a solder type, and a squeegee type; an option display unit which displays the options of each selection item in an image display area; and a printing condition setting unit which reads out, from the library, a printing condition corresponding to a combination of selected options, and which sets the read-out printing condition to a printing control unit which operates the printing execution unit.

4 Claims, 12 Drawing Sheets

FIG. 5A
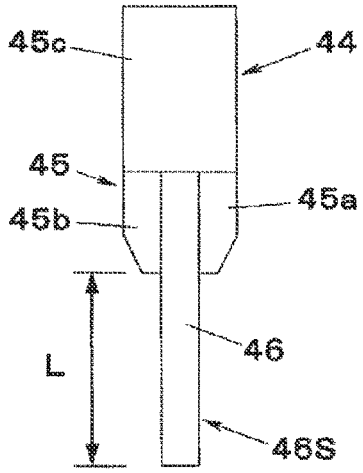
FIG. 5B1
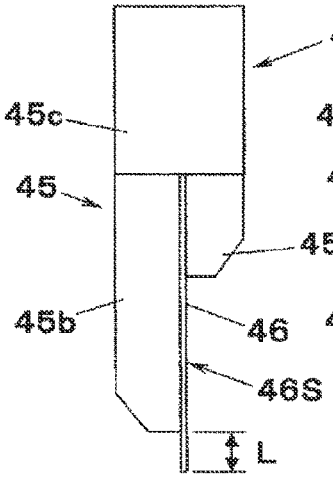
FIG. 5B2
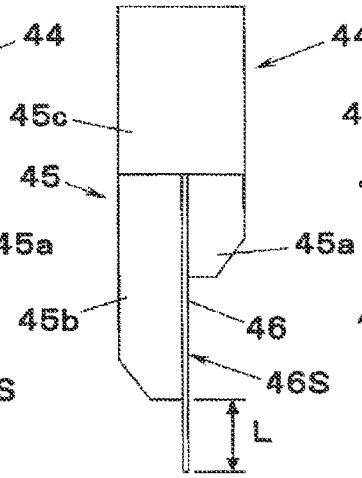
FIG. 5B3
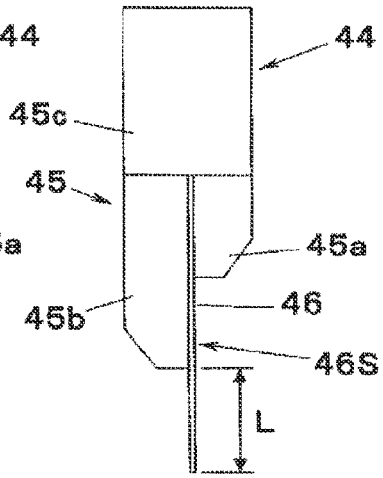

FIG. 9

TB

| COMBINATION NO. 001 | | LOW SPEED | STANDARD SPEED | HIGH SPEED |
|---|---|---|---|---|
| PRINTING PARAMETER | OPERATION MODE | * | * | * |
| | PRINTING SPEED | *** | *** | *** |
| | PRINTING PRESSURE | *** | *** | *** |
| | PLATE RELEASING SPEED | *** | *** | *** |
| | PLATE RELEASING STROKE | *** | *** | *** |
| | PLATE RELEASING MODE | * | * | * |
| MASK CLEANING PARAMMETER | NUMBER OF RECIPROCATIONS | * | * | * |
| | CLEANING INTERVAL | ** | ** | ** |
| | GO SPEED | *** | *** | *** |
| | RETURN SPEED | *** | *** | *** |
| | SUCTION ON/OFF | * | * | * |
| | CLEANING MODE | * | * | * |
| | CLEANING MODE | * | * | * |
| | CLEANING MODE | * | * | * |
| | CLEANING MODE | * | * | * |

SCREEN PRINTING MACHINE OPERATING BASED ON PRINTING CONDITIONS

BACKGROUND

1. Technical Field

An aspect of the present invention relates to a screen printing machine for forming a print of solder on a board by filling a patter hole of a mask contacting the board with solder by sliding a squeegee relative to the mask and thereafter separates the board from the mask.

2. Background Art

A screen printing machine performs a screen printing operation of forming a print of solder on a board in a pre-process of a process of mounting components on the board in a components mounter which is disposed on a downstream side. The screen printing machine includes: a mask having pattern holes; and a printing execution unit which fills the pattern hole of the mask contacting a board with solder by sliding a squeegee relative to the mask and thereafter separates the board from the mask. To perform the screen printing operation by the screen printing machine, it is necessary to set a printing condition containing a plurality of operation parameters for operation of the printing execution unit. However, there are many kinds of operation parameters which should be input by an operator, such as a squeegee movement speed, a printing pressure, a plate releasing speed, etc. To set the printing condition by inputting the operation parameters one by one, the operator is required to have sufficient knowledge and experiences. In view of this, for example, JP-A-H07-032717 describes a screen printing machine which can automatically set the printing condition by an operator by inputting only items that do not require knowledge or experiences such as a solder type and a mask type, instead of inputting every operation parameter.

SUMMARY

In recent years, the size of lands of the board have been reduced to satisfy the need of high-density mounting, and the difficulty of screen printing for producing a board having lands has been increased. As a result, even in the screen printing machine disclosed in JP-A-H07-032717, it is difficult to set the printing condition for highly difficult screen printing, and the operator is required to directly input operation parameters such as a squeegee movement speed, a printing pressure, and a plate releasing speed.

An object of an aspect of the present invention is to provide a screen printing machine which allows an operator to set a proper printing condition easily by simple manipulations and which can perform high-quality screen printing.

In an aspect of the present invention, there is provided a screen printing machine including: a mask haying a pattern hole; a printing execution unit which fills the pattern hole with solder by sliding a squeegee on the mask contacting a board and thereafter separates the board from the mask; a library which stores printing conditions, each of which includes operation parameters for operation of the printing execution unit and corresponds to a combination of options of selection items which include a board type, a solder type, and a squeegee type; an option display unit which displays the options of each of the selection items in an image display area; and a printing condition setting unit which reads out, from the library a printing condition corresponding to a combination of options selected from the options of the selection items displayed in the image display area, and which sets the read-out printing condition to a printing control unit which operates the printing execution unit.

According to an aspect of the present invention, it is possible to set a proper printing condition easily by simple manipulations and perform high-quality screen printing.

BRIEF DESCRIPTION OF THE DRAWINGS

FIGS. 5A, 5B1, 5B2, and 5B3 are side views of various squeegees used in the embodiment of the invention;

FIG. 9 is an image diagram showing tables of printing conditions stored in an operation parameter library of the control device of the screen printing machine according to the embodiment of the invention;

DETAILED DESCRIPTION

Figure 1:
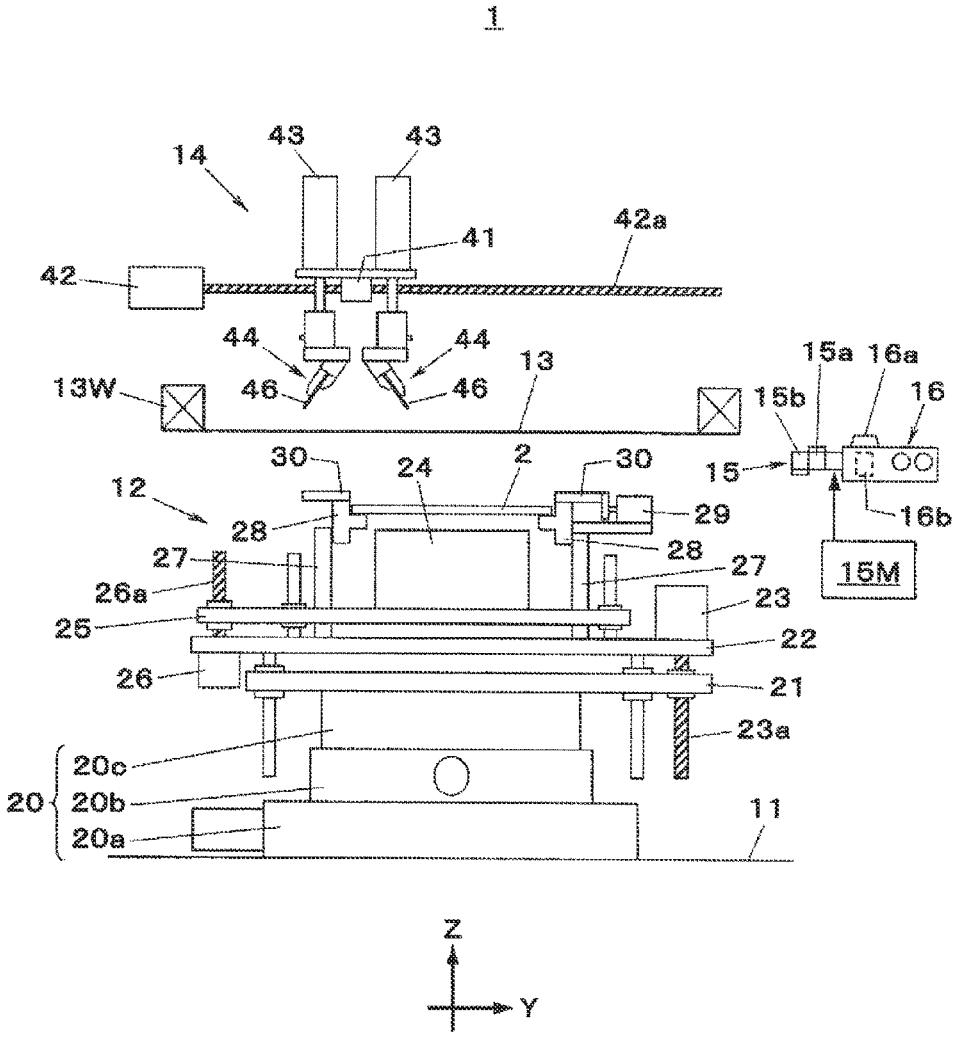
FIG. 1 is a side view of a screen printing machine according to an embodiment of the present invention.
Figure 2:
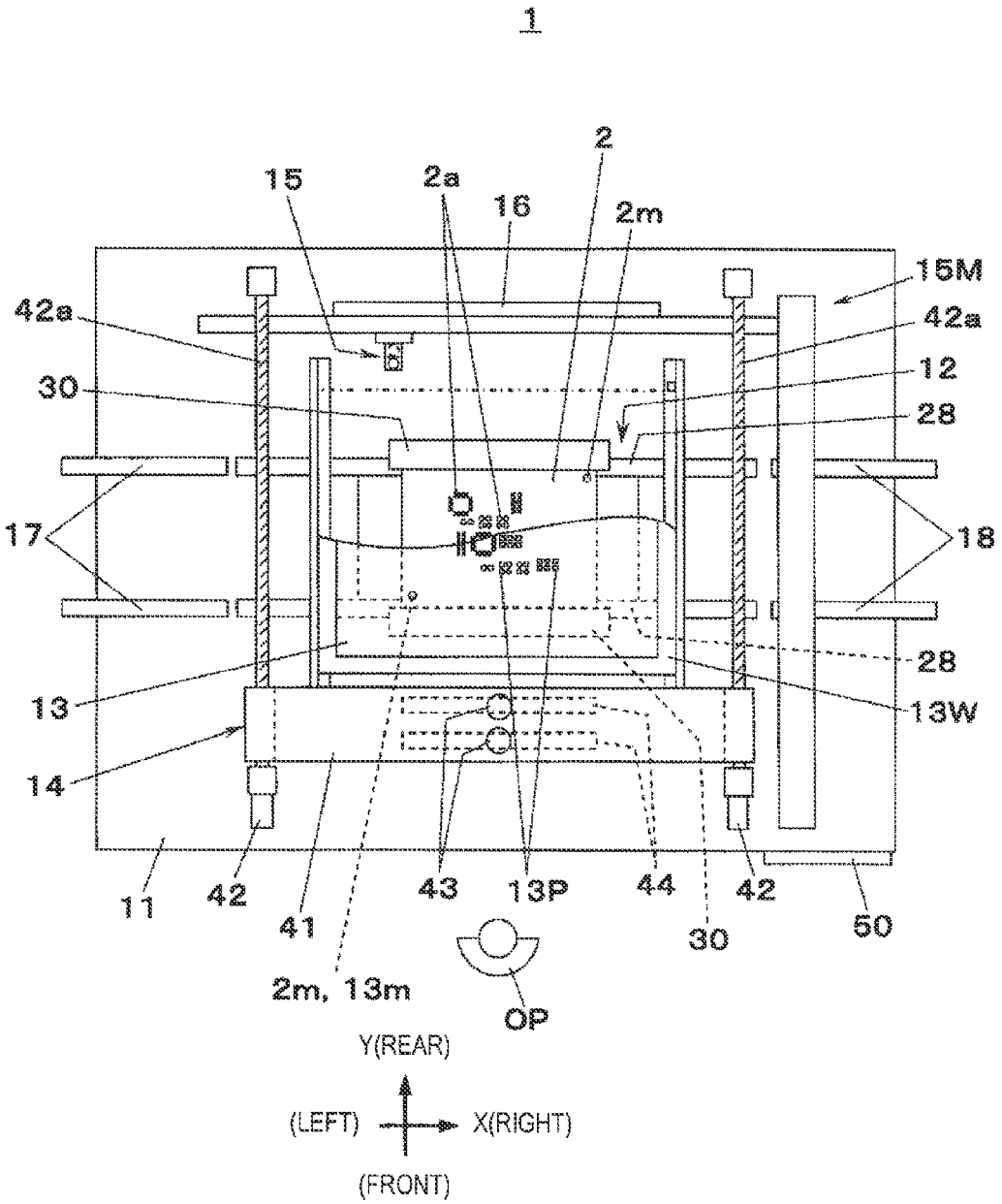
FIG. 2 is a plan view of the screen printing machine according to the embodiment of the invention.

An embodiment of the present invention will be hereinafter described with reference to the drawings. FIGS. 1 and 2 show a screen printing machine I according to the embodiment of the invention. The screen printing machine I is a machine for screen-printing a layer of solder H on electrodes 2*a* of a board 2 that is fed from an upstream-process machine (e.g., board supply machine) and carrying out the resulting board to a downstream-process machine (e.g., components mounter). In the embodiment, the flowing direction of a board 2 in the screen printing machine 1 is a horizontal direction that goes left to right in FIG. 2 (i.e., the left-right direction as view by an operator OP), which is defined as the X-axis direction. The horizontal direction (i.e., the front-rear direction as view by the operator OP) that is perpendicular to the X-axis direction is defined as the Y-axis direction, and the top-bottom direction is defined as the Z-axis direction. In the embodiment, the left-hand side in the paper surface of FIG. 2. corresponds to the upstream side (upstream-process side) of the flow of a board 2 and the right-hand side in the paper surface of FIG. 2 corresponds to the downstream side (downstream-process side) of the flow of a board 2.

As shown in FIGS. 1 and 2, the screen printing machine 1 is composed of a board holding/moving mechanism 12 disposed on a base stage 11, a mask 13 disposed over the board holding/moving mechanism 12, a squeegeeing mechanism 14 disposed over the mask 13, and a camera unit 15 and a mask cleaner 16 which are disposed under the mask 13. As shown in FIG. 2, a carry-in conveyor 17 for transferring, to the board Holding/moving mechanism 12, a board 2 carried in from the upstream-process machine is disposed on the base stage 11 upstream of the board holding/moving mechanism 12 in the board flow direction. And a carry-out conveyor 18 for receiving a board 2 fed out from the board holding/moving mechanism 12 and carrying it out to the downstream-process machine is disposed on the base stage 11 downstream of the board holding/moving mechanism 12 in the board flow direction.

As shown in FIG. 1, the board holding/moving mechanism 12 is composed of a base table 21 which is translated and rotated with respect to the base stage 11 by means of an XYθ table mechanism 20 including a Y table 20*a*, an X table 20*b*, and a θ table 30*c* which can be moved relative to each other; a first elevation table 22 disposed over the base table 21; a first elevation motor 23 for elevating and lowering the first elevation table 22 with respect to the base table 21 by driving a first ball screw 23*a;* a second elevation table 25 which is disposed over the first elevation table 22 and whose top surface is provided with a board receiving member 24; and a second elevation motor 26 for elevating and lowering the second elevation table 25 with respect to the first elevation table 22 by driving a second ball screw 26*a*.

The board holding/moving mechanism 12 is also equipped with a pair of (front and rear) support members 27 which extend upward from the first elevation table 22, a pair of conveyors 28 which are supported by the respective support members 27, respectively, and convey a board 2 in the X-axis direction, and a pair of dampers (clamping members) 30 which are disposed over the pair of conveyors 28 so as to be opposed to each other in the Y-axis direction and opened and closed by in the Y-axis direction by a damper opening/closing cylinder 29.

As shown in FIGS. 1 and 2, the mask 13 is shaped like a rectangular fiat plate extending in an XY plane and its outer circumferential portion is supported by a frame member 13W. Pattern holes 13P that are arranged so as to correspond to electrodes 2*a* of a board 2 are formed in the mask 13. A pair of board-side murky 2*m* are formed in a board 2 at diagonal positions, and a pair of mask-side marks 13*m* are formed in the mask 13 at such positions as to correspond to the respective board-side marks 2*m*.

As shown in FIG. 1, the squeegeeing mechanism 14 is composed of a mobile base 41 extending in the X-axis direction, two squeegee moving motors 42 for moving the mobile base 41 in the Y-axis direction by driving respective ball screws 42*a* rotationally; two squeegee elevation cylinders 43 which are disposed on the mobile base 41 on as to be opposed to each other in the Y-axis direction (i.e., in the front-rear direction), squeegee holders 45 attached to piston rods 43*a* of the squeegee elevation cylinders 43, respectively, and squeegees 44 attached to the respective squeegee holders 45.

Figure 3:
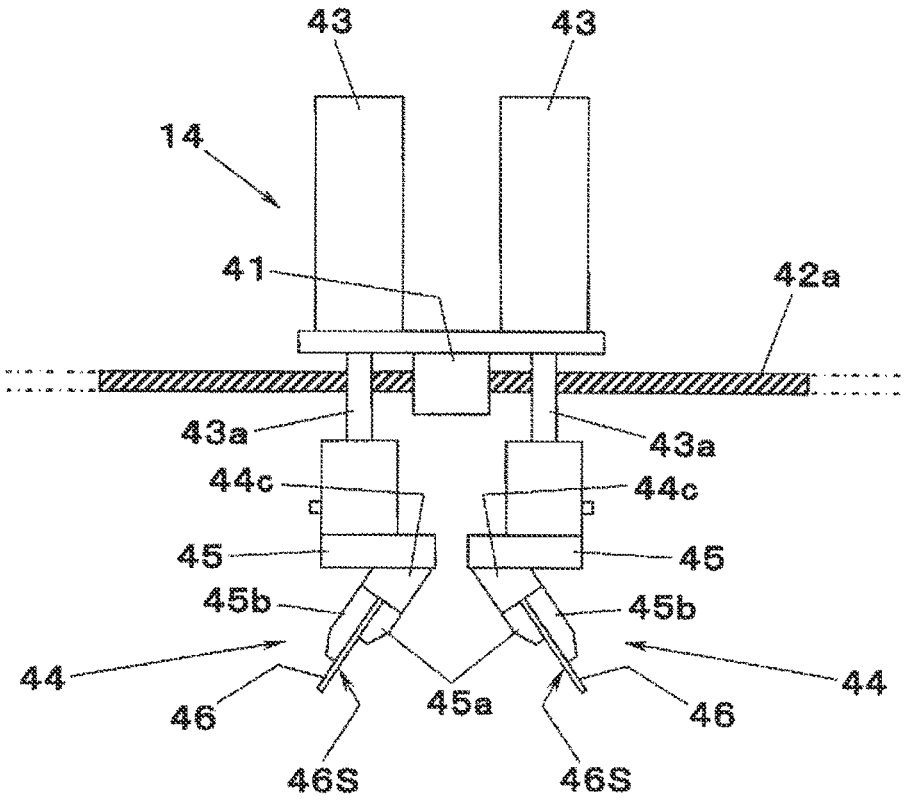
FIG. 3 is a side view of part of a squeegeeing mechanism of the screen printing machine according to the embodiment of the invention.

As shown in FIG. 3, each squeegee 44 is composed of a base member 44*c* attached to the squeegee holder 45, a flat-plate-like blade 46, and aloud-aide support block 45*a* and a tail-side support block 45*b* which fix the blade 46 to the base member 44*c*. A top portion of the blade 46 is nipped by the lead-side support block 45*a* and the tail-side support block 45*b* and the blade 46 is thereby fixed to the base member 44*c*. A bottom portion of the blade 46 projects downward relative to the bottom end of the tail-side support block 45*b* by a prescribed length, in the embodiment, this portion of the blade 46 will be called a projection portion. As shown in FIGS. 1 and 3, the two squeegees 44 are attached to the respective squeegee holders 45 so that the distance (in the Y-axis direction) between their blades 46 increases downward. The confronting surfaces of the two blades 46 are solder squeegeeing surfaces 46S.

Figure 4:
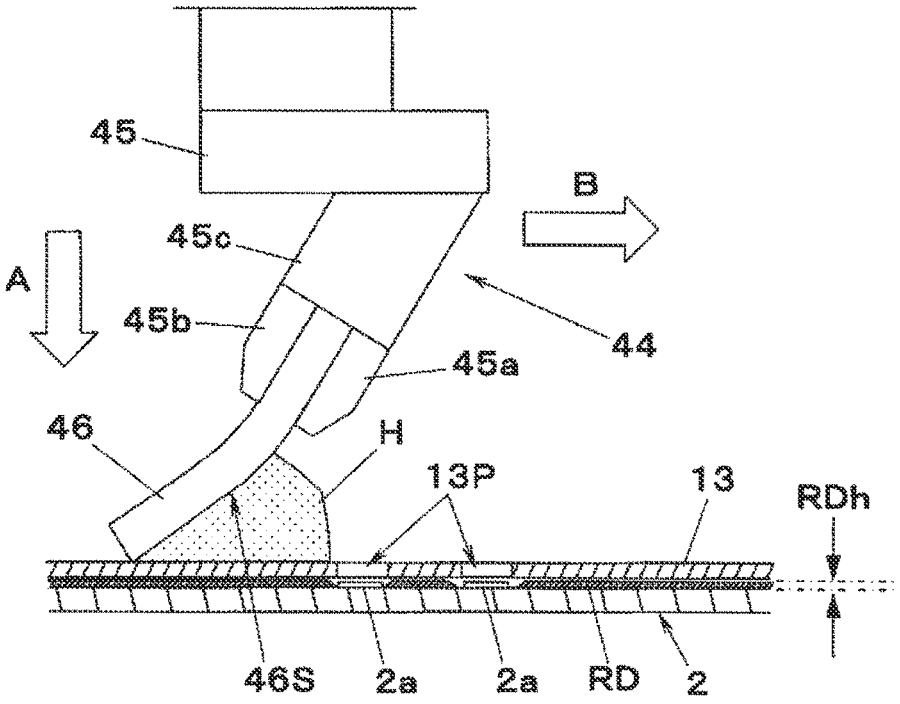
FIG. 4 shows a state that a blade of a squeegee of the squeegeeing mechanism of the screen printing machine according to the embodiment of the invention is pressed against a mask.

The two squeegee elevation cylinders 43 are activated independently of each other, and each time one of the two squeegees 44 arranged in the front-rear direction is lowered and brought into contact with the top surface of the mask 13 (indicated by arrow A in FIG. 4). When the two squeegee moving motors 42 move the mobile base 41 in the Y-axis direction by driving the respective ball screws 42*a* synchronously in a state that the blade 46 of one squeegee 44 is in contact with the mask 13, the blade 46 is slid on the mask 13. The direction in which the squeegee moving motors 42 move the mobile base 41 in this manner is the direction in which the solder squeegeeing surface 46S of the blade 46 being in contact with the mask 13 is advanced (indicated by arrow B in FIG. 4), Printing pressure which is pressure for pressing each squeegee 44 against the mask 13 is produced as a result of an operation that the corresponding squeegee elevation cylinder 43 lowers the squeegee 44 and thereby causes the bottom end of its blade 46 to be pressed against the mask 13 (see FIG. 4). That is, in the embodiment, the squeegee elevation cylinders 43 serve as a printing pressure producing unit. The printing pressure of each squeegee 44 can be adjusted at will using the output of the squeegee elevation cylinder 43 that elevates and lowers it. Therefore, an output value of the corresponding squeegee elevation cylinder 43*a* is displayed in place of a printing pressure value. The printing pressure producing unit may be a driving mechanism other than a cylinder, such as one using a motor and a feed screw or one using a linear motor.

FIGS. 5A, 5B1, 5B2, and 5B3 show various squeegees 44 used in the screen printing machine 1. The types of squeegees 44 are classified by the material of the blade 46 and the structure of the squeegee 44. FIGS. 4 and 5A show an example squeegee 44 whose blade 46 is made of urethane (urethane squeegee). FIGS. 5B1, 5B2, and 5B3 show example squeegees 44 whose blades 46 are made of metal (metal squeegees). In the embodiment, there are three types of metal squeegees whose projection portions have different lengths (hereinafter referred to as projection portion lengths L). The material of the blade 46 and the projection portion length L are parameters that influence the screen printing quality.

As shown in FIGS. 1 and 2, the camera unit 15 is equipped with an upward imaging camera 15*a* having an upward imaging view field and a downward imaging camera 15*a* having a downward imaging view field. The camera unit 15 is moved across a horizontal plane under the mask 13 by a camera/cleaner moving mechanism ISM which is an XY table mechanism. The upward imaging camera 15*a* obtains an image of the mask-side marks 13*m* of the mask 13 and the downward imaging camera 15*a* obtains an image of the board-side marks 2*m* of a board 2 being clamped by the pair of dampers 30. A mask cleaner 16 is configured in such a manner that a paper member 16*a* to be brought into contact with the bottom surface of the mask 13 is directed upward.

In the screen printing machine 1, a print of solder H is formed on a board 2 in such a manner that the board 2 held by the board holding/moving mechanism 12 is brought into contact with the bottom surface of the mask 13, one squeegee 44 is slid on the mask 13 by the squeegeeing mechanism 14 to fill the pattern holes 13P of the mask 13 with solder H, and the board 2 is separated from the mask 13 by activating the board holding/moving mechanism 12 (described later in detail). As such, in the embodiment, the squeegeeing mechanism 14 and the board holding/moving mechanism 12 serve as a printing execution unit which fills the pattern holes 13P with solder H by sliding one squeegee 44 on the mask 13 which contacts aboard 2 and thereafter separates the board 2 from the mask 13.

As shown in FIG. 2, the screen printing machine 1 is provided with a touchscreen 50 on its surface (front surface) to face an operator OP. An operator OP sets a printing condition which contains values etc. of plural operation parameters for operation of the printing execution unit (squeegeeing mechanism 14 and board holding/moving mechanism 12) by making touch manipulations of touching an image display area 50G (see FIG. 6) of the touchscreen 50 (described later in detail).

Figure 7:
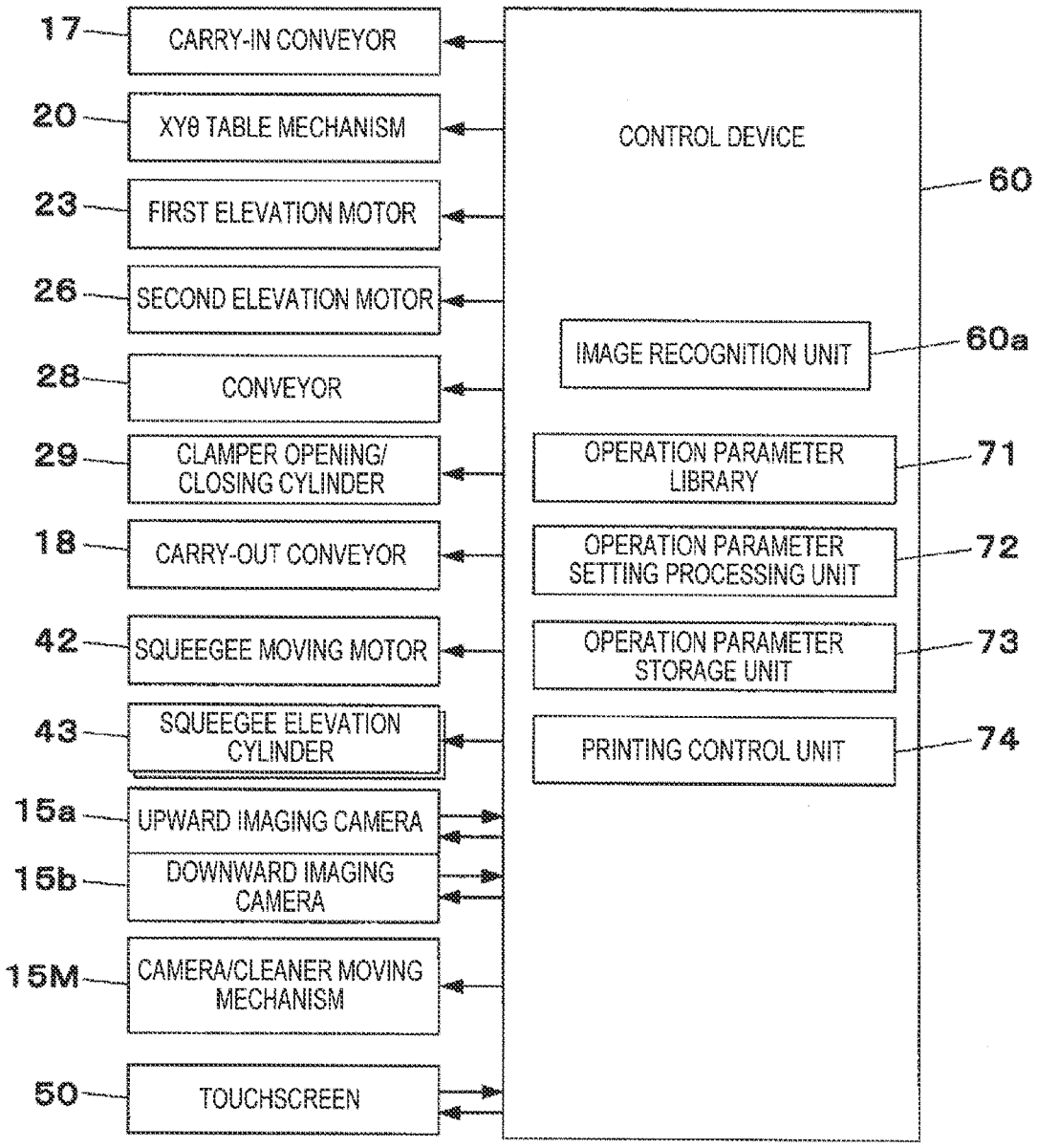
FIG. 7 is a block diagram of a control system of the screen printing machine according to the embodiment of the invention.

As shown in FIG. 7, a control device 60 of the screen printing machine 1 controls an operation of carrying in a board 2 by means of the carry-in conveyor 17, an operation of positioning the board 2 at a working position by means of the conveyors 28, an operation of elevating or lowering the first elevation table 22 (i.e., elevating or lowering the board receiving member 24) by means of the first elevation motor 23, an operation of opening or closing the clampers 30 by means of the dampers opening/closing cylinder 29, an operation of translating or rotating the base table 21 with respect to the base stage l\ by means of the XYθ table 20, an operation of elevating or lowering the second elevation table 25 (i.e., bringing the board 2 into contact with the mask 13 or separating the former from the latter) by means of the second elevation motor 26, and an operation of carrying out the board 2 by means of the carry-out conveyor 18. The control device 60 also controls an operation of elevating each squeegee 44 or lowering each squeegee 44 (i.e., pressing it against the mask 13) by means of the corresponding squeegee elevation cylinder 43, an operation of moving each squeegee 44 in the Y-axis direction by means of the squeegee moving motors 42, and an operation of moving the camera unit 15 and the mask cleaner 16 by means of the camera/cleaner moving mechanism 15M.

As shown in FIG. 7, the control device 60 also controls imaging by the upward imaging camera 15*a* and imaging by the downward imaging camera 15*b*. Image data taken by the upward imaging camera 15*a* and image data taken by the downward imaging camera 15*b* are sent to the control device 60, and an image recognition unit 60*a* (see FIG. 7) of the control device 60 performs image recognition processing on the basis of the received image data.

As shown in FIG. 7, the touchscreen 60, which is connected to the control device 60, receives and displays instructions and various kinds of information that are necessary for operating the screen printing machine 1 and performs other processing. The control device 60 displays an input picture 50*a* which allows an operator OP to input values or the like of items that are necessary setting a printing condition (mentioned above; see FIG. 6). The touchscreen 60 sends options of the respective items that have been input (selected) by the operator OP through the input picture 50*a*. The control device 60 sets a printing condition on the basis of a combination of the options of the items sent from the touchscreen 60.

Figure 6:
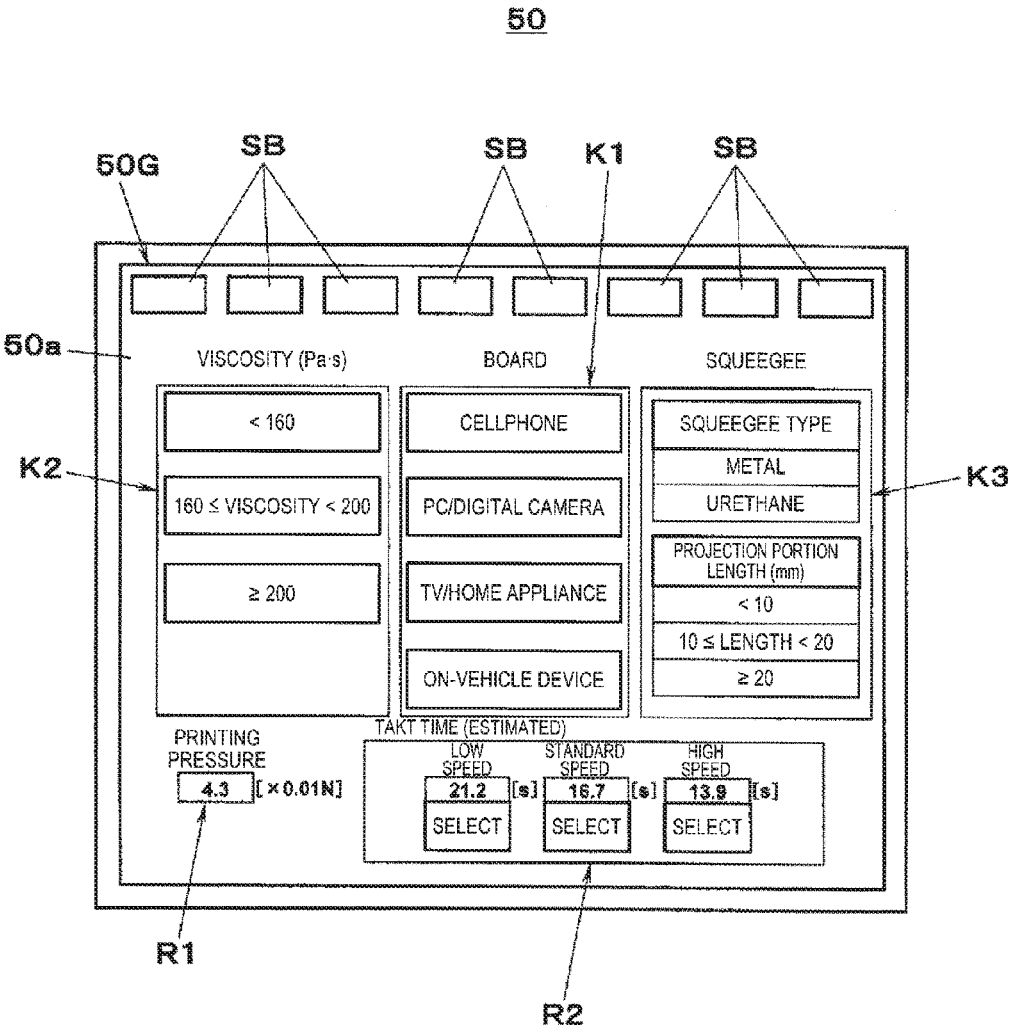
FIG. 6 shows an example input picture that is displayed in an image display area of a touchscreen that is provided in the screen printing machine according to the embodiment of the invention.
Figure 8:
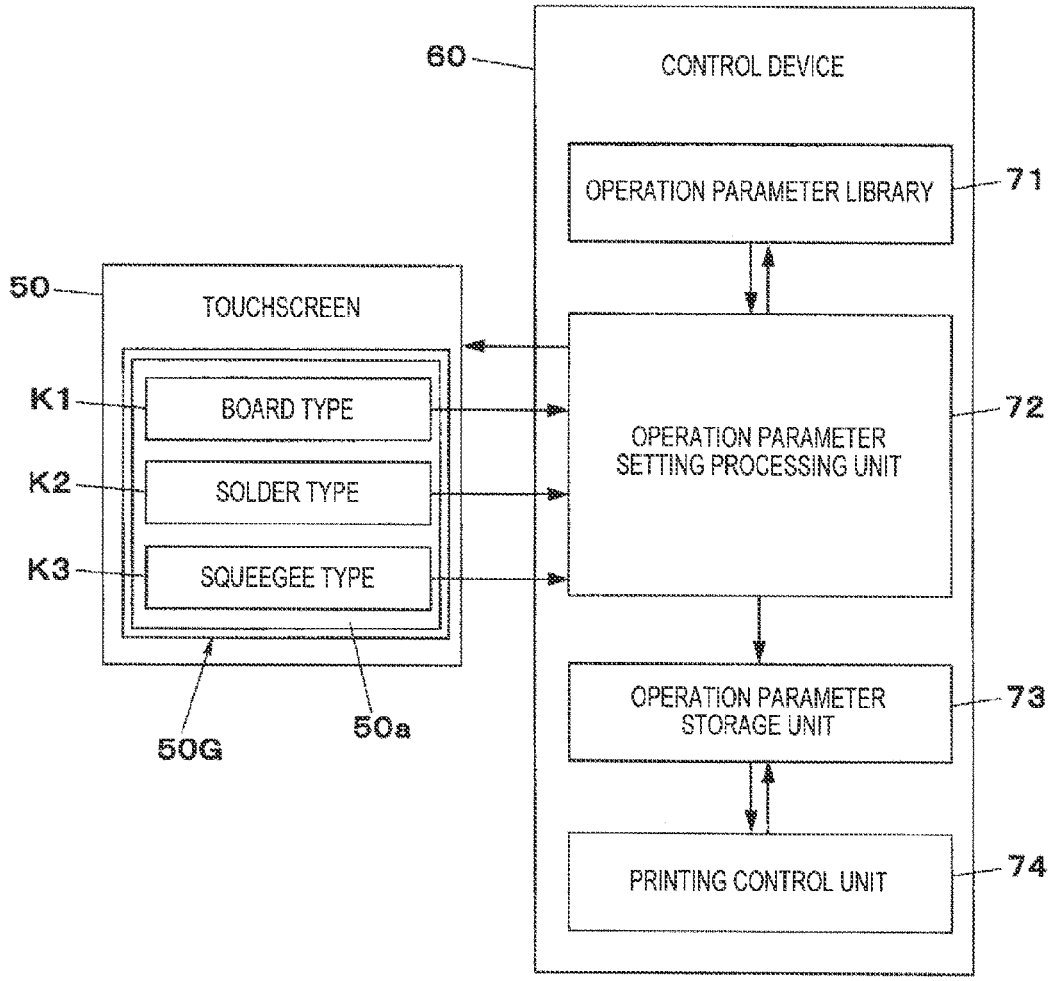
FIG. 8 is a block diagram showing how a control device controls the touchscreen in the screen printing machine according to the embodiment of the invention.

As shown in FIGS. 6 and 8, options of a first selection item K1 obtained by classifying types of boards 2 as solder H printing subjects by the thickness of a resist RD formed on the surface of a board 2 (resist thickness RDh; see FIG. 4), options of a second selection item K2 obtained by classifying types of solders H to be used by the viscosity of solder H, and options of a third selection item K3 obtained by classifying types of squeegees 44 by the structure of a squeegee 44 and the material of a blade 46 are displayed in the input picture 50*a*. In the example of FIG. 6, the types of boards 2 are classified by the viscosity (unit: Pa·s) of solder H into three options "lower than 160," "higher than or equal to 160 and lower than 200," and "higher than or equal to 200," The types of boards 2 are classified by the resist thickness RDh into four options "cellphones," "PCs/digital cameras," "TVs/consumer electronics appliances," and "vehicular devices" (the resist thickness RDh increases in order of "cellphones," "PCs/digital cameras," "TVs/consumer electronics appliances," and "vehicular devices"). The types of squeegees 44 are classified into two options "metal" and "urethane" when done by the material of a blade 46 and into three options "shorter than 10," "longer than or equal to 10 and shorter than 20, " and "longer than or equal to 20" when done by the structure, that is, the projection portion length L (unit: mm).

The reason why as described above the options of the first selection item K1 are obtained by classifying the types of solders H to be used by the viscosity of solder H is that the viscosity of solder H influences, to a large extent, the release speed (plate releasing speed) of a board 2 with respect to the mask 13 at the time of plate releasing of the board 2 from the mask 3 whose pattern holes 13P are filled with solder H. The reason why the options of the second selection item K2 are obtained by classifying the types of boards 2 by the resist thickness RDh of a board 2 is that the resist thickness RDh influences, to a large extent, operation parameters, particularly the printing pressure. The reason why the options of the third selection item K3 are obtained by classifying the types of squeegees 44 by the structure of a squeegee 44 and the material of a blade 46 is that the structure of the squeegee 44 and the material of the blade 46 influence, to a large extent, the printing pressure through the degree of bend of the blade 46 when it slides on the mask 13 (sec FIG. 4). The printing condition is influenced by the manner of combining of options of the above three kinds of selection items, and the inventors have completed the invention on the basis of conception of an idea that narrowing-down into the printing condition that are suitable for solder H screen printing could be done easily on the basis of a combination of options of these three selection items.

To set a printing condition before causing the screen printing machine 1 to perform screen printing, an operator OP selects a proper one of the options of each of the above three items through the input picture 50*a* being displayed in the image display area 50G of the touchscreen 50. This is done by the operator OP by touching corresponding portions on the image display area 50G with a finger.

As shown in FIGS. 7 and 8, the control device 60 is equipped with an operation parameter library 71, an operation parameter setting processing unit 72, an operation parameter storage unit 73, and a printing control unit 74. The operation parameter library 71 functions as a library that is stored with sets of printing conditions containing values etc. of operation parameters for operation of the printing execution unit for respective combinations of a board 2 type, a solder H type, and a squeegee 44 type. For example, as shown in FIG. 9, the operation parameter library 71 stores a plurality of printing conditions in the form of tables TB that is the same in number as all combinations of options. Each table TB shown in FIG. 9 contains not only values etc. of the operation parameters of the printing execution unit (a printing condition) but also values etc. of mask cleaning parameters which are contained in a condition (a cleaning condition) for cleaning of the mask 13 by the mask cleaner 16. In the embodiment, the operation parameters relating to the printing condition are called "printing parameters" and the operation parameters relating to the cleaning condition are called "mask cleaning parameters."

For example, as shown in FIG. 9, the printing condition contains values etc. of parameters (printing parameters) for determination of a printing speed that relates to a speed of movement of a squeegee 44 in the Y-axis direction by the squeegee moving motors 42, a printing pressure that relates to output power of the squeegee elevation cylinders 43, a plate releasing speed that relates to a speed of lowering of the first elevation table 22 by the first elevation motor 23 (i.e., a lowering speed of a board 2 held by the dampers 30), and other things. On the other hand, the cleaning condition contains values of operation parameters of the mask cleaner 16 and the camera/cleaner moving mechanism 15M for moving it which are, for example, as shown in FIG. 9, parameters (mask cleaning parameters) for determination of the number of times of reciprocation across the mask 13, a cleaning interval, go and return operation speeds, and other things. The values etc. of the operations parameters are determined by actually carrying out screen printing operations using the screen printing machine 1 for every combination of options of the above-described three items.

"Combination numbers" shown in FIG. 9 are unique numbers that are assigned to the respective combinations of the options of the selection items. The operation parameter setting processing unit 72 is configured so as to read out values etc. of the operation parameters that are registered so as to be correlated with a combination number corresponding to a combination of options of the three selection items. Furthermore, sets of values and pieces of operation-related information of the operation parameters are set for respective printing speed levels "low," "standard," and "high." The values and pieces of operation-related information (of the operation parameters) that are set for the printing speed level "standard" define standard printing condition and cleaning condition to satisfy both of stable printing quality and high productivity. The values and pieces of operation-related information that are set for the printing speed level "low" define printing condition and cleaning condition for printing in which importance is attached to printing quality. The values and pieces of operation-related information that are set for the printing speed level "high" define printing condition and cleaning condition for printing in which importance is attached to productivity on condition that necessary printing quality is secured.

The operation parameter setting processing unit 72 of the control device 60 performs a control for displaying the input picture 50*a* in the image display area 50G of the touchscreen 50 (described above). And the operation parameter setting processing unit 72 also functions as a printing condition setting unit for reading out, from the operation parameter library 71, a printing condition corresponding to a combination of options of the items selected by an operator OP from the sets of options displayed in the image display area 500 and setting them in the printing control unit 74 for operating the printing execution unit.

The operation parameter storage unit 73 of the control device 60 functions as a. temporary storage unit for temporarily storing the printing condition selected by the operation parameter setting processing unit 72. The printing control unit 74 of the control device 60 functions as a printing control unit for operating the printing execution unit (i.e., squeegeeing mechanism 14 and board holding/moving mechanism 12) on the basis of values and pieces of operation-related information (of the operation parameters) stored in the operation parameter storage unit 73. That is, processing that the operation parameter setting processing unit 72 stores values and pieces of operation-related information of the printing parameters as the printing condition in the operation parameter storage unit 73 corresponding to processing of setting values and pieces of operation-related information of the printing parameter in the printing control unit 74.

As soon as an operator OP selects a proper option of the first selection item K1, a proper option of the second selection item K2, and a proper option of the third selection item K3, the selected options are sent from the touchscreen 50 to the operation parameter setting processing unit 72. The operation parameter setting processing unit 72 reads out, from the operation parameter library 71, values and pieces of operation-related information of the operation parameters corresponding to the combination of the options sent from the touchscreen 50 and stores them in the operation parameter storage unit 73. Thus, a state that the control device 60 has set the printing condition is established.

As described above, in the embodiment, the operation parameter setting processing unit 72 of the control device 60 serves as an option displaying unit for displaying, in the image display area 500 of the touchscreen 50, plural options for each of the board 2 type, the solder H type, and the squeegee 44 type which are items necessary for setting the printing condition (values etc. of the operation parameters) under which to operate the printing execution unit, that is, the squeegeeing mechanism 11 and the board holding/moving mechanism 12.

In the embodiment, a board 2 type, a solder H type, and a squeegee 44 type which are necessary for setting the printing condition can each be input by a simple method of selecting one of plural options. Therefore, the printing condition can be set easily by simple manipulations without any knowledge or experiences.

In the embodiment, the operation parameter setting processing unit 72 displays, in a printing pressure display region R1 (see FIG. 6) of the input picture 50*a* displayed on the touchscreen 50, a printing pressure of the printing condition selected according to details (i.e., a combination of options) of inputs made by an operator OP. Basically, the operator OP need not directly input values etc. of the individual operation parameters of the printing execution unit in setting the printing condition (manual inputting). However, resultingly, the operator OP can immediately recognize a printing pressure to occur under the thus-set printing condition. Therefore, if, for example, judging that the printing pressure is not appropriate, the operator OP makes fine adjustments on the operation parameters by making manual inputs. Switching to a picture for manual input of values etc. of operation parameters is made by touching a proper one of menu switching manipulation items SB which are located at the top of the input picture 50*a*.

In the embodiment, the operation parameter setting processing unit 72 calculates takt times (unit: s) corresponding to the three printing speed levels "low," "standard," and "high" on the basis of values etc, of the operation parameters selected according to details (i.e., a combination of options) of inputs made by an operator OP and displays them in a takt time display region R2 (see FIG. 6) of the input picture 50*a* of the touchscreen 50. Takt times are calculated on the basis of information relating to the size of a board 2 to be manufactured and selected values etc. of the operation parameters.

A takt time for the printing speed level "standard" is calculated on the basis of the values etc. of the parameters that are set for the printing speed level "standard" among sets of values etc. of the parameters that correspond to the combination of options selected by the operator OP. Likewise, a takt time for the printing speed level "low" is calculated on the basis of the values etc. of the parameters that are set for the printing speed level "low" and a takt time for the printing speed level "high" is calculated on the basis of the values etc. of the parameters that are set for the printing speed level "high," As a result, the operator OP can recognize, in advance, takt times of a standard printing operation, a printing operation in which importance is attached to printing quality, and a printing operation in which importance is attached to productivity, respectively, and hence can set values etc. of the operation parameters that can provide a proper takt time in connection with takt times etc. of other machines disposed upstream and downstream of the screen printing machine 1. If the operator OP pushes a selection button of a box that exists in the input picture 50*a* and in which a takt time corresponding to the printing speed level "low," "standard," or "high" is displayed, the operation parameter setting processing unit 72 reads out the values etc. of the operation parameters corresponding to the manipulated button from the operation parameter library 71 and stores them in the operation parameter storage unit 73. This means that printing condition and cleaning condition have been set in the printing control unit 74. The control device 60 may include, e.g., a memory configured to store instructions; and at least one processor configured to execute the instructions to cause the screen printing machine to provide at least one of the units provided in the control device 60 or to execute at least one of the operations of the control device 60.

The configuration of the screen printing machine 1 according to the embodiment has been described above. Next, a description will be made of work of setting values etc. of the operation parameters in the screen printing machine 1 and a screen printing operation performed by the screen printing machine 1, First, an operator OP causes the input picture 50*a* to be displayed on the touchscreen 50 and inputs viscosity of solder H (first selection item K1), a board 2 type (second selection item K2), and a squeegee 44 type (third selection item K3). In response, the operation parameter setting processing unit 72 reads out the values etc. of the operation parameters corresponding to the combination of the thus-input options of the three selection items, calculates three takt times, and displays them in the input picture 50*a*. The operator OP manipulates a selection button that is associated with a proper one of the takt times corresponding to the respective printing speed levels "low," "standard," and "high." In response, the operation parameter setting processing unit 72 stores the corresponding values etc. of the operation parameters in the operation parameter storage unit 73. The work of setting values etc. of the operation parameters in the screen printing machine 1 is thus completed. Upon completion of the parameters setting work, the screen printing machine 1 performs a screen printing operation in a manner described below.

For the screen printing machine 1 to form a print of solder H on a board 2, first, the carry-in conveyor 17 carries in the board 2 from an upstream-process machine (e.g., board supply machine) and positions the board 2 at a prescribed working position (carry-in step). The second elevation motor 26 elevates the second elevation table 25 and thereby pushes up the board 2, that is, lifts it up from the conveyors 28, by means of the board support member 24. Then the damper opening/closing cylinder 29 is operated to close the dampers 30, whereby the board 2 is held (clamped) in the Y-axis direction (board holding step).

After the clamping of the board 2 by the dampers 30, the camera unit 15 is moved under the mask 13 and the upward imaging camera 15*a* and the downward imaging camera 15*b* obtain images of the mask-side marks 13*m* and the board-side marks 2*m*, respectively. The image recognition unit 60*a* of the control device 60 recognizes positions of the mask 13 and the board 12 by performing image recognition on the mask-side marks 13*m* and the board-side marks 2*m*. The XYθ table mechanism 20 moves the base table 21 and thereby positions the board 2 with respect to the mask 13 (positioning step). Then the first elevation motor 23 elevates the first elevation table 22 and thereby brings the board 2 into contact with the mask 13 (contacting step).

Figure 10:
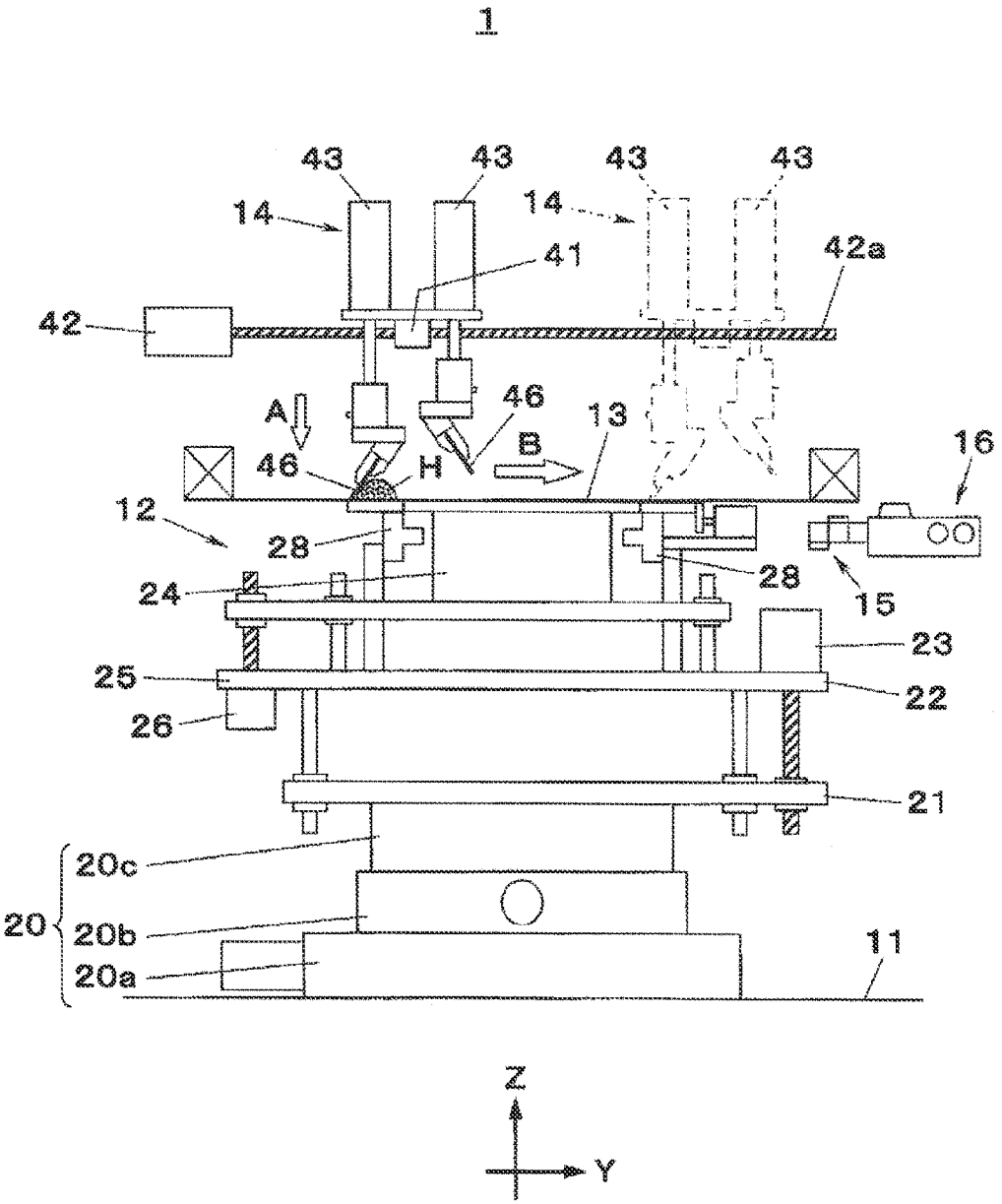
FIG. 10 illustrates a first part of a screen printing operation of the screen printing machine according to the embodiment of the invention.

After the contact of the board 2 to the mask 13, one squeegee elevation cylinder 43 lowers the associated squeegee 44 and thereby brings it into contact with the mask 13 (indicated by arrow A in FIG. 10) and the squeegee moving motors 42 moves the mobile base 41 in the Y-axis direction (indicated by arrow B in FIG. 10). As a result, the squeegee 44 is slid on the mask 13 and squeegees solder H that has been supplied onto the mask 13 in advance. The pattern holes 13P of the mask 13 are thus filled with solder H (solder filling step).

Figure 11:
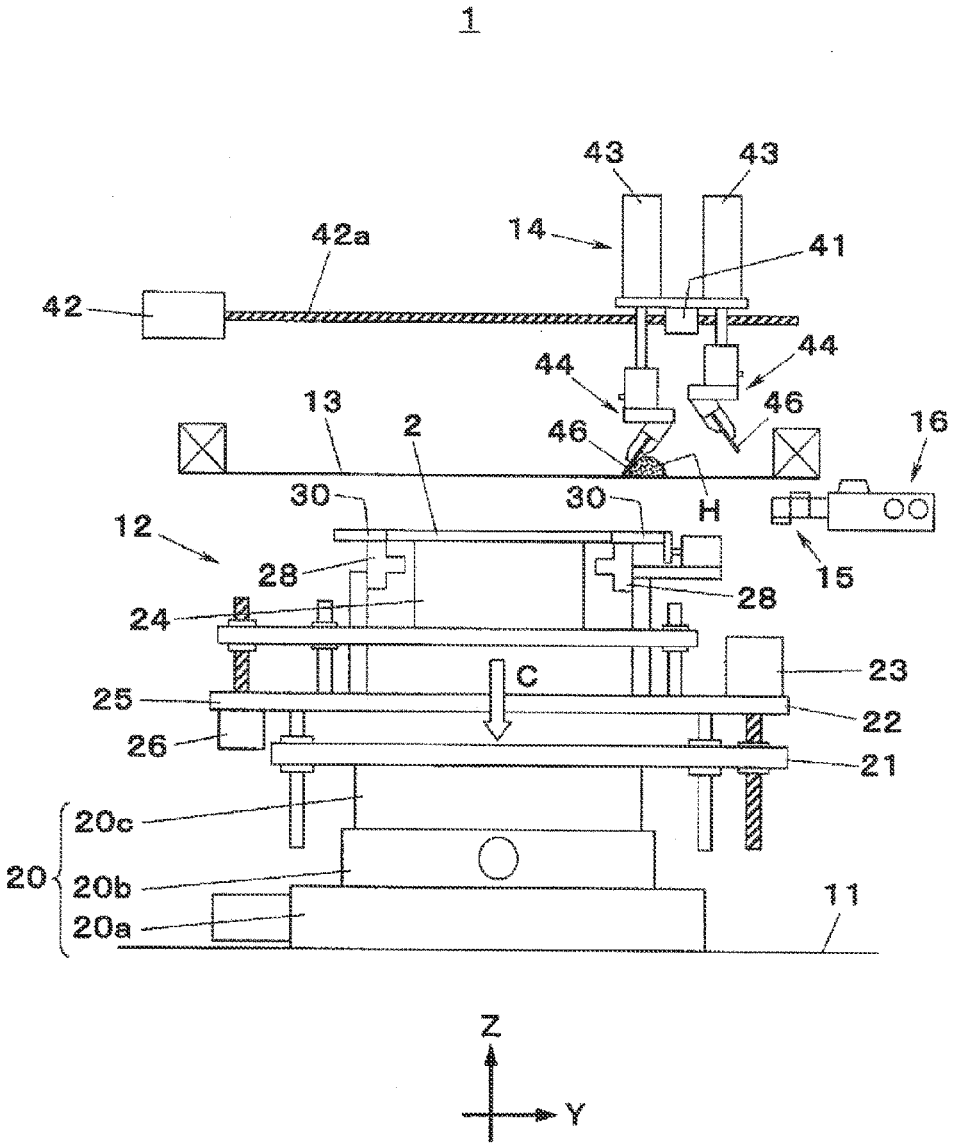
FIG. 11 illustrates a second part of the screen printing operation of the screen printing machine according to the embodiment of the invention.

After the completion of the filling of the pattern holes 13P of the mask 13 with solder H, the first elevation motor 23 lowers the first elevation table 22 (indicated by arrow C in FIG. 11) and thereby separates it from the mask 13 (plate releasing step). After the separation of the board 2 from the mask 13, the damper opening/closing cylinder 29 opens the dampers 30 and thereby cancels the clamping of the board 2. Then the second elevation motor 26 lowers the second elevation table 25 and thereby places the board 2 onto the conveyors 28. After the placing of the board 2 onto the conveyors 28, the carry-out conveyor 28 carries out the board 2 to a downstream-process machine such as a components mounter (carry-out step). Thus, the screen printing operation for the one board 2 is completed.

Since the series of steps of the above screen printing operation are executed under a proper printing condition that are set in accordance with a board 2 type, a solder H type, and a squeegee 44 type that have been input by the operator OP, a print of solder H can be formed with quality that is higher than a certain level even if the board 2 has minute lands thigh-density-mounted board 2). Highly-difficult, high-quality screen printing can thus be performed repeatedly while a certain level of quality is maintained.

Figure 12:
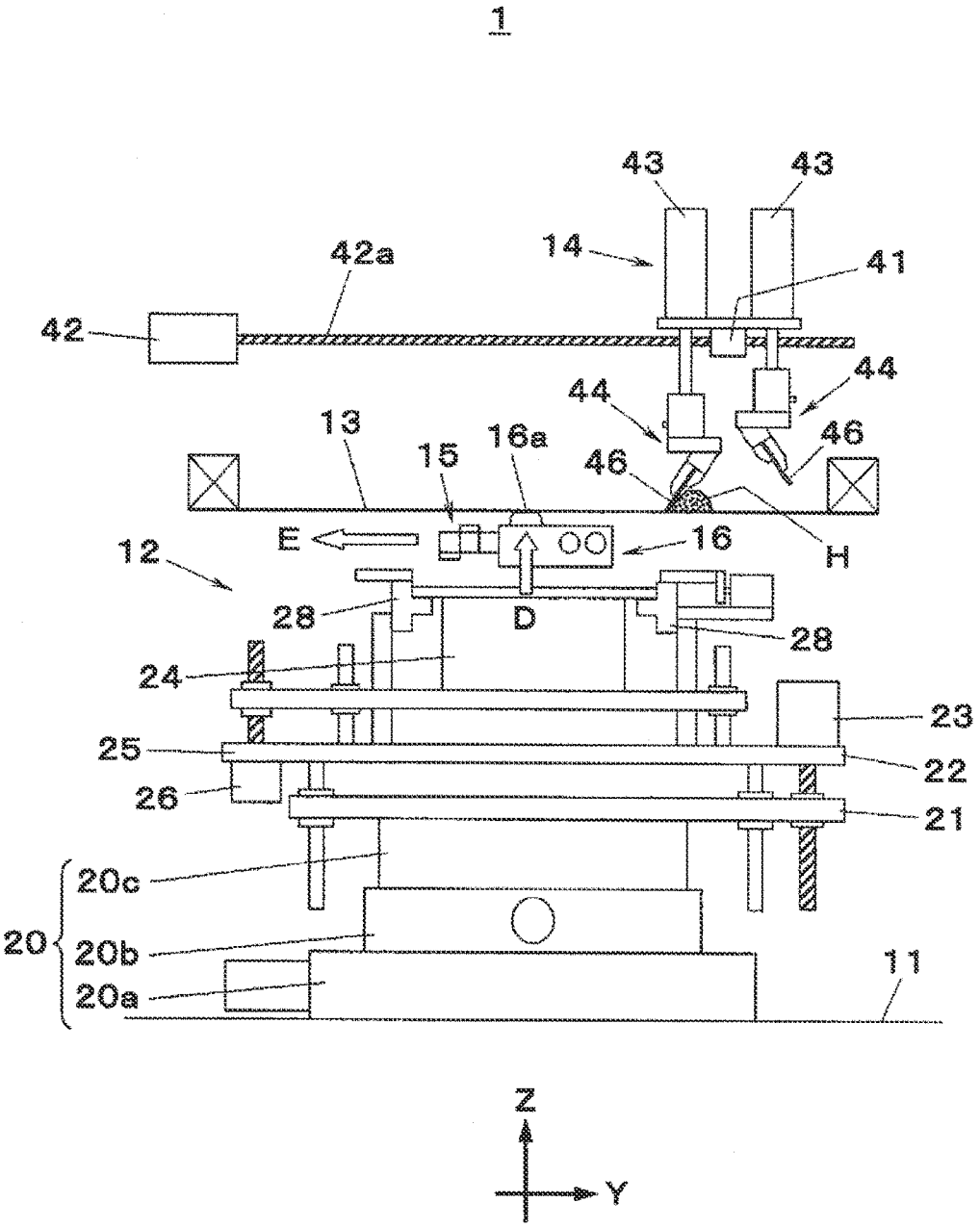
FIG. 12 illustrates a mask cleaning operation of the screen printing machine according to the embodiment of the invention.

The mask cleaner 16 cleans the mask 13 every time a screen printing operation for one board 2 is performed one or several times. After being moved to under the mask 13 by the camera/cleaner moving mechanism 15M, the mask cleaner 16 is moved in the Y-axis direction under the mask 13 (indicated by arrow E in FIG. 12) in a state that the paper member 16*a* is in contact with the bottom surface of the mask 13 (indicated by arrow D in FIG. 12). Thus, the mask cleaner 16 wipes away, with the paper member 16*a*, the solder H that is stuck to the bottom surface of the mask 13.

The mask cleaner 16 cleans the mask 13 in this manner under the mask cleaning condition contained in a table TB together with the printing condition.

As described above, the screen printing machine I according to the embodiment can perform high-quality screen printing on a high-density-mounted board 2 because a proper printing condition is set using the three items, that is, the board 2 type a, the solder H type, and the squeegee 44 type. To make inputs for each of the above items, a method is employed in which an operator OP selects one of plural options. When the operator OP selects options for the respective items, the printing condition corresponding to the combination of the selected options is read out and the printing execution unit operates under the read-out printing condition. Therefore, the printing condition can be set easily by simple manipulations without any knowledge or experiences.

The invention is not limited to the above embodiment may be practiced with various modifications to the embodiment. For example, although in the embodiment the options of the three selection items are displayed so as to be arranged in the input picture 50*a*, they may be displayed in the form of pull-down menus. Although in the embodiment cleaning condition is also determined from a combination of options selected by an operator OF, only the printing condition may be determined with cleaning condition set outside the processing. Furthermore, although in the embodiment an operator OP sets values etc. of the operation parameters by selecting a proper one of the printing speed levels "low," "standard," and "high" by checking respective takt times displayed, values etc. of the operation parameters corresponding to a particular, predetermined printing speed may be set in the printing control unit 7'4 without selection by an operator OR Still further, although in the embodiment the operation parameter library 71 is stored with sets of values etc. of the operation parameters that are classified by the printing speed level ("low", "standard," or "high"), each set corresponding to a combination of options of the three selection items, it may be stored with sets of values etc. of the operation parameters only for the standard printing speed level. In this case, the printing condition can be set in the printing control unit 74 merely by selecting one of options of each of the three selection items. However, in this case, to adjust the takt time taking the line balance into consideration, it becomes necessary to adjust operation parameters through manual inputting. Therefore, setting values etc. of the operation parameters for each of the printing speed levels "low", "standard," and "high" is preferable in that the frequency of complicated manual inputting can be lowered.

According to the embodiments of the invention, it is possible to provide a screen printing machine which allow an operator to set proper the printing condition easily by simple manipulations and which can perform high-quality screen printing.

What is claimed is:

1. A screen printing machine comprising:

a mask having a pattern hole;

a printing execution unit which fills the pattern hole with solder by sliding a squeegee on the mask contacting a board and thereafter separates the board from the mask;

a library which stores printing conditions, each of which comprises operation parameters for operation of the printing execution unit and corresponds to a combination of options of selection items which comprise a board type, a solder type, and a squeegee type;

an option display unit which displays the options of each of the selection items in an image display area;

a printing control unit which operates the printing execution unit based on the operation parameters of the printing conditions stored in the library; and a printing condition setting unit which reads out, from the library, a printing condition corresponding to a combination of options selected from the options of the selection items displayed in the image display area, and which sets the read-out printing condition to the printing control unit, wherein the option display unit displays an estimated takt time calculated based on a combination of selected options.

2. The screen printing machine according to claim 1, wherein the options of the board type displayed by the option display unit classified by a thickness of a resist formed on a surface of the board.

3. The screen printing machine according to claim 1, wherein the options of the solder type displayed by the option display unit are classified by solder viscosity.

4. The screen printing machine according to claim 1, wherein the options of the squeegee type displayed by the option display unit are classified by a structure of the squeegee and a material of a blade used for the squeegee.

* * * * *